US007423369B2

(12) United States Patent
Ono et al.

(10) Patent No.: US 7,423,369 B2
(45) Date of Patent: Sep. 9, 2008

(54) COLD CATHODE FOR DISCHARGE LAMP HAVING DIAMOND FILM

(75) Inventors: Tomio Ono, Kanagawa (JP); Tadashi Sakai, Kanagawa (JP); Naoshi Sakuma, Kanagawa (JP); Hiroaki Yoshida, Kanagawa (JP); Mariko Suzuki, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 86 days.

(21) Appl. No.: 11/366,468

(22) Filed: Mar. 3, 2006

(65) Prior Publication Data

US 2007/0046170 A1 Mar. 1, 2007

(30) Foreign Application Priority Data

Aug. 24, 2005 (JP) ..... 2005-243253

(51) Int. Cl.
*H01J 17/04* (2006.01)

(52) U.S. Cl. ..... 313/491; 313/633; 313/632; 313/631

(58) Field of Classification Search ..... 313/493, 313/309–311, 491, 627–643, 567, 631, 336, 313/355, 352, 346 R
See application file for complete search history.

(56) References Cited

U.S. PATENT DOCUMENTS

| | | | | |
|---|---|---|---|---|
| 2,875,367 | A * | 2/1959 | Beggs | 313/340 |
| 3,005,926 | A * | 10/1961 | Horner et al. | 313/337 |
| 5,729,082 | A * | 3/1998 | Snijkers | 313/346 R |
| 5,880,559 | A | 3/1999 | Fox et al. | |
| 5,962,977 | A * | 10/1999 | Matsumoto et al. | 313/633 |
| 6,281,626 | B1 * | 8/2001 | Nakamura et al. | 313/491 |
| 6,781,294 | B2 | 8/2004 | Sakai et al. | |
| 7,034,447 | B2 | 4/2006 | Sakai et al. | |
| 2002/0140352 | A1 * | 10/2002 | Sakai et al. | 313/633 |
| 2005/0017627 | A1 * | 1/2005 | Asai et al. | 313/491 |
| 2005/0017644 | A1 | 1/2005 | Ono et al. | |
| 2005/0062392 | A1 | 3/2005 | Sakai et al. | |
| 2005/0174030 | A1 * | 8/2005 | Katsap | 313/346 R |
| 2005/0184640 | A1 * | 8/2005 | Yamashita et al. | 313/493 |
| 2005/0218773 | A1 | 10/2005 | Ono et al. | |
| 2005/0264157 | A1 * | 12/2005 | Sakai et al. | 313/311 |

FOREIGN PATENT DOCUMENTS

| | | |
|---|---|---|
| JP | 4-137429 | 5/1992 |
| JP | 9-35685 | 2/1997 |
| JP | 2000-11866 | 1/2000 |
| JP | 2000-90876 | 3/2000 |
| JP | 2001-185078 | 7/2001 |
| JP | 2002-298777 | 10/2002 |

(Continued)

OTHER PUBLICATIONS

U.S. Appl. No. 11/223,029, filed Sep. 12, 2005, unknown.

(Continued)

*Primary Examiner*—Joseph L Williams
(74) *Attorney, Agent, or Firm*—Oblon, Spivak, McClelland, Maier & Neustadt, P.C.

(57) ABSTRACT

A cold cathode for a discharge lamp includes a metal plate that has bending portions; a diamond film that is formed on a face of the metal plate, except for the bending portions; and a metal member that is mounted on the metal plate.

12 Claims, 9 Drawing Sheets

FOREIGN PATENT DOCUMENTS

| | | |
|---|---|---|
| JP | 2003-132850 | 5/2003 |
| JP | 2003-281991 | 10/2003 |
| JP | 2004-158468 | 6/2004 |
| JP | 2005-108564 | 4/2005 |

OTHER PUBLICATIONS

U.S. Appl. No. 11/366,468, filed Mar. 3, 2006, Ono et al.
U.S. Appl. No. 11/366,468, filed Mar. 3, 2006, Ono et al.
U.S. Appl. No. 11/467,439, filed Aug. 25, 2006, Ono et al.

* cited by examiner

COLD CATHODE FOR DISCHARGE LAMP HAVING DIAMOND FILM

CROSS-REFERENCE TO RELATED APPLICATIONS

This application is based upon and claims the benefit of priority from the prior Japanese Patent Application No. 2005-243253, filed on Aug. 24, 2005; the entire contents of which are incorporated herein by reference.

BACKGROUND OF THE INVENTION

1. Field of the Invention

The present invention relates to a cold cathode for discharge lamps, a cold cathode discharge lamp, and a method of manufacturing the cold cathode for discharge lamps that are used in lighting equipment, the backlights for liquid crystal displays, the light sources for general-purpose lighting apparatuses, and the likes.

2. Description of the Related Art

Discharge lamps are essential in industrial fields and everyday life, and account for approximately half of the light sources for lighting equipment. Particularly, the production of cold cathode discharge lamps as the backlight sources for liquid crystal displays and light sources for general-purpose lighting apparatuses has been rapidly growing in recent years.

An example of a cold cathode discharge lamp is a cold cathode fluorescent lamp. In a cold cathode fluorescent lamp, a pair of cold cathodes facing each other are disposed in a glass tube, and an inert gas and a minute amount of mercury (Hg) are contained in the glass tube. When a high voltage is applied to the pair of cold cathodes, discharge starts between both electrodes. The discharge is maintained to excite the mercury, and ultraviolet rays are generated, so that the fluorescent material emits light. Barrier-type cold cathode discharge lamps are also known. A barrier-type cold cathode discharge lamp has an electrode outside the tube forming the discharge space, and the electrode is not in contact with the discharge surface.

Compared with a conventional hot cathode fluorescent lamp, a cold cathode discharge lamp characteristically has a very long service life, while causing less breaking in hot filaments and consuming less emitter materials for electron emission. Because of this, cold cathode discharge lamps are being widely used for the industrial lighting equipment in which replacing the light sources is difficult. Particularly, there is an increasing demand for cold cathode discharge lamps as the backlight sources for liquid crystal displays.

So as to improve the performances of cold cathode discharge lamps, the present inventors have been developed cold cathode discharge lamps using diamond as an electron emitting material of the cathodes (see Japanese Patent Application (Kokai) Nos. 2002-298777 and 2003-132850). Since diamond has a high secondary emission efficiency and a high sputter resistance, a cold cathode discharge lamp with a high emission efficiency and a long service life can be provided.

In such a cold cathode side of a cold cathode discharge lamp, a cold cathode having diamond coating on a metal material of cylindrical shape, cup-like shape, or the like is employed so as to obtain a high discharge current (see U.S. Pat. No. 5,880,559, for example).

However, a cold cathode for a discharge lamp produced with bulk diamond is very costly. Therefore, a diamond film is normally formed on the surface of a metal material, which has various forms, by the CVD (Chemical Vapor Deposition) method, as disclosed in U.S. Pat. No. 5,880,559. By the CVD method, a diamond film can be uniformly formed on a flat metal material.

When a diamond film is formed by the CVD method, it is possible to form a diamond film with uniform thickness on several flat base members. However, uniform film formation is difficult on non-flat base members having cylindrical or cup-like shapes, for example. In U.S. Pat. No. 5,880,559, for example, the inside of a cup-like member and the inside of a tube-like member are coated with diamond. However, by the CVD method, it is very difficult to form a diamond film with uniform in-plane thickness on a non-flat base member.

SUMMARY OF THE INVENTION

According to one aspect of the present invention, a cold cathode for a discharge lamp includes a metal plate that has bending portions; a diamond film that is formed on a face of the metal plate, except for the bending portions; and a metal member that is mounted on the metal plate.

According to another aspect of the present invention, A cold cathode discharge lamp includes a cold cathode that includes a metal plate having bending portions, a diamond film formed on faces of the metal plate, except for the bending portions, and a metal member mounted on the metal plate; a glass tube that has the cold cathode therein, and has a fluorescent material applied to an inner wall thereof; and an inert gas that is contained in the glass tube.

According to still another aspect of the present invention, a method of manufacturing a cold cathode for a discharge lamp includes forming a diamond film on a predetermined region of a metal plate that is turned into a three-dimensional structure having an opening by bending; forming the three-dimensional structure having an opening by bending the metal plate having the diamond film formed thereon; mounting a metal rod in the opening; and securing the metal rod to the metal plate.

According to still another aspect of the present invention, a method of manufacturing a cold cathode for a discharge lamp includes forming a resist pattern on portions of a metal plate that is turned into a three-dimensional structure having an opening by bending, the portions including a portion at which the metal plate is bent to be turned into the three-dimensional structure, and a portion at which a joint member for securing a metal rod to the metal plate; adhering diamond particles to the metal plate having the resist pattern formed thereon; removing the resist pattern from the metal plate having the diamond particles applied thereto; forming a diamond film on a region to which the diamond particles are adhered; forming the three-dimensional structure by bending the metal plate having the diamond film formed thereon; mounting the metal rod in the opening of the metal plate formed three-dimensional structure; and mounting the joint member for securing the metal rod to the metal plate.

DETAILED DESCRIPTION OF THE INVENTION

Figure 1:
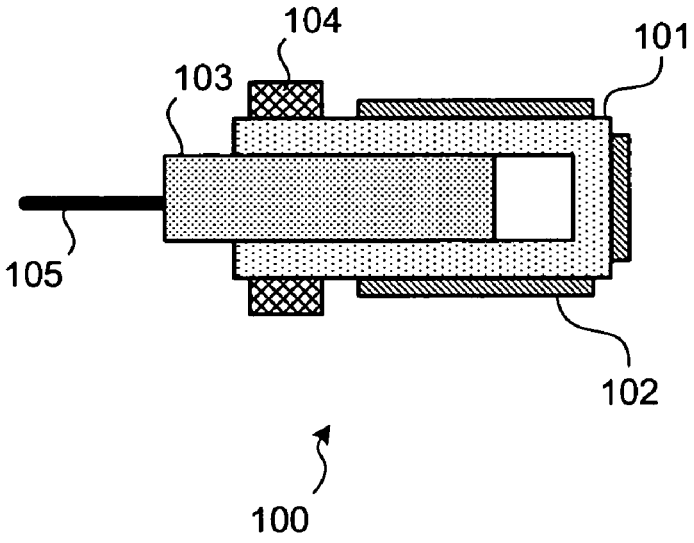
FIG. 1 is a cross-sectional view of a cold cathode according to a first embodiment of the present invention.

FIG. 1 is a cross-sectional view of a cold cathode 100 according to a first embodiment. As shown in FIG. 1, the cold cathode 100 includes a metal rod 103 having an extension lead 105 for applying a voltage from the outside, a metal base (hereinafter also referred to as "metal plate") 101 in a box-like shape having an opening face, a diamond thin film 102 formed on the flat face of the metal base 101, and a joint member 104 for securing the metal base 101 to the metal rod 103.

The metal used for the metal rod 103 may be any type of metal, as long as it has conductivity. In this embodiment, nickel is used, for example. The metal rod 103 is a rectangular parallelepiped in this embodiment. However, the shape of the metal rod 103 is not particularly limited, and may be a stick-like, plate-like, or ring-like structure. However, the metal rod 103 should preferably have such a shape as to be easily conductive to the metal base 101 that is in contact with the metal rod 103.

The metal used for the metal base 101 preferably has a melting point of 1000° C. or higher. As a diamond film is to be formed on the surface of the metal base 101 by the CVD method, the metal base 101 should preferably be made of a metal having such a high melting point as to be resistant to high-temperature treatment (at 800° C., for example) that is carried out for forming the diamond film. The metal base 101 should be made of molybdenum or tungsten, for example. In this embodiment, the metal base 101 is made of tungsten. Accordingly, the metal used for the metal base 101 can be prevented from melting when the diamond thin film 102 is formed on the metal base 101, and the metal base 101 can be coated with the diamond thin film 102.

The metal base 101 is bent at predetermined bending portions so as to form the box-like structure. One of the faces of the box-like structure is open, and the metal rod 103 is inserted through the opening. The locations of the bending portions will be described later.

The diamond thin film 102 is formed on the outer faces of the metal base 101, except for the bending portions shaping the box-like shape. The diamond thin film 102 also has the p-type conductivity, and is doped with boron (B) in this embodiment. However, the diamond thin film 102 of the present invention is not limited to this structure. The surface of the diamond thin film 102 is hydrogen-terminated, and has negative electron affinity. Accordingly, when electrons are excited to a conduction band in the vicinity of the surface of the diamond thin film 102, discharging is easily performed. Thus, the secondary emission efficiency can be dramatically increased. In this case, the discharge current rapidly increases immediately after the start of voltage application, and the discharge efficiency is dramatically increased.

Also, since the diamond thin film 102 is highly resistance to sputtering, little wear damage is caused, and a long service life can be achieved. When the diamond thin film 102 is used, the film may be of a single crystalline type or a polycrystalline type. In this embodiment, a polycrystalline film is used. The process of forming the diamond thin film 102 on the metal base 101 will be described later.

The joint member 104 is used for joining and securing the metal rod 103 in the metal base 101.

Figure 2:
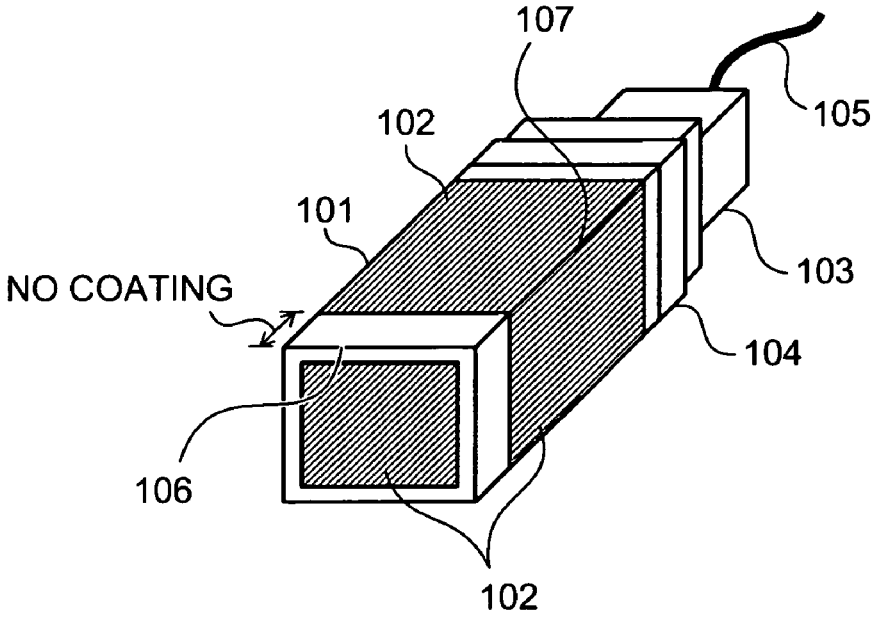
FIG. 2 is an external view of the cold cathode according to the first embodiment.

FIG. 2 is an external view of the cold cathode 100 according to this embodiment. As shown in FIG. 2, the metal base 101 has a box-like shape having one opening face as the opening portion. In this box-like shape, the face opposite from the opening portions through which the metal rod 103 is inserted is set as the end face, and the faces adjacent to the end faces are set as side faces. In such a case, the corner portions 106 between the end face and the side faces, which are the bending portions, do not have the diamond thin film 102 formed thereon. Accordingly, even if heat expansion is caused in the metal rod 103 or the metal base 101, damage to the diamond thin film 102 can be prevented. Although the corner portions 107 between the side faces are coated with the diamond thin film 102, the diamond thin film 102 is not integrally formed on the corner portion 107, and accordingly, the diamond thin film 102 is not damaged even if heat expansion is caused in the metal base 101. The structure of the corner portions 107 will be described later in greater detail in conjunction with the description of the procedures for producing the metal base 101 in the box-like shape.

When a conventional metal material having an extension lead is integrally coated with a diamond thin film, the variation in volume due to heat expansion tends to be restricted once discharging starts, and, because of this, a load is put on the diamond thin film. As a result, the load causes damage such as cracks in the diamond thin film.

To counter this problem, the corner portions 106 of the metal base 101 are not coated with the diamond thin film 102 in this embodiment, as shown in FIG. 2. Accordingly, even if heat expansion is caused in the metal rod 103 or the metal base 101, the volume variation of the diamond thin layer 102 due to the heat expansion is not restricted. Thus, a load due to heat expansion is not put on the diamond thin film 102, and damage to the diamond thin film 102 can be prevented.

Figure 3:
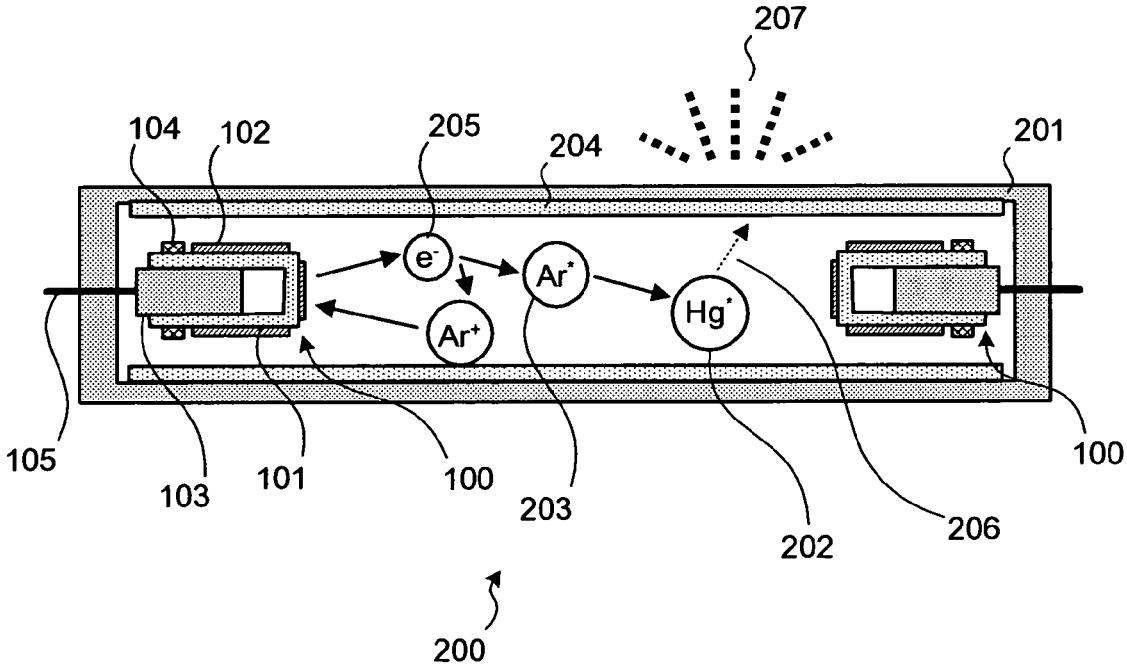
FIG. 3 shows a phenomenon caused in a cold cathode discharge lamp using cold cathodes of this embodiment.

Next, a cold cathode discharge lamp using the cold cathodes 100 is described. FIG. 3 shows the phenomenon that is caused in a cold cathode discharge lamp 200 using the cold cathodes 100. In FIG. 3, a minute amount of mercury 202 and argon (Ar) 203 are contained in a glass tube 201, and a fluorescent film 204 made of a fluorescent material that generates visible light from ultraviolet rays is formed along the inner wall of the glass tube 201. The cold cathodes 100 are disposed at both ends of the glass tube 201. In this embodiment, the gas contained in the glass tube 201 is not limit to argon (Ar) gas 203, but may be any inert gas.

Here, an "inert gas" is a gas that is very stable and is not easily brought into combination with other elements. Examples of such inert gases include helium (He), neon (Ne), argon (Ar), krypton (Kr), xenon (Xe), and radon (Rn).

When a high voltage is applied from the outside to the cold cathodes 100 in this cold cathode discharge lamp 200 via the extension lead 105, the cold cathodes 100 start discharging. Once the discharge starts, the ionized contained gas collides with the diamond thin films 102 forming the discharge face of the cold cathodes 100, thereby causing secondary electron emission. As a result, electrons 205 are emitted from each diamond thin film 102. The electrons 205 are then accelerated to collide with the atoms of the contained gas, and ionize the atoms. Here, cycles of collision and ionization are established. Because of this, the voltage required for maintaining the discharge becomes lower than the voltage required at the start of the discharge. The contained mercury 202 is excited when colliding with the electrons 205 or the ionized or excited contained inert gas, to generate ultraviolet rays 206. The ultraviolet rays 206 collide with the fluorescent film 204, so that the fluorescent material of the fluorescent film 204 is excited and generates visible light 207.

In the cold cathode discharge lamp 200 having the cold cathodes 100 with diamond thin films, the discharge starting voltage and the discharge maintaining voltage become lower due to the high secondary emission efficiency of diamond, and accordingly, the electric power required for light emission can be reduced. Thus, the luminous efficiency can be increased.

Figure 4A:
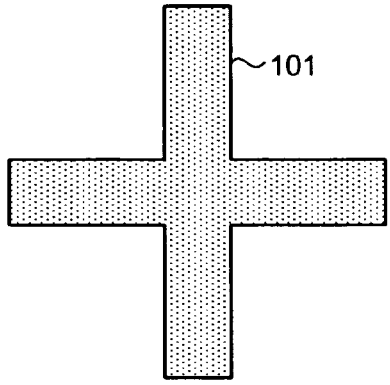
FIGS. 4A to 4D show the procedures for producing a thin-film metal plate in a box-like shape that is used in the cold cathode of the first embodiment and has a diamond thin film formed thereon.

Next, the method of manufacturing a cold cathode for discharge lamps according to the present invention is described. FIGS. 4A to 4D show the procedures for producing the metal member 101 in a box-like shape having the diamond thin film 102 formed thereon in the cold cathode 100 of this embodiment. As shown in FIG. 4A, a metal plate is etched to produce such a cross-like form as to become a box-like structure having an opening. The thickness of the metal plate is not particularly set, but may preferably be so thin that a bending process can be performed in a later stage.

Figure 4B:
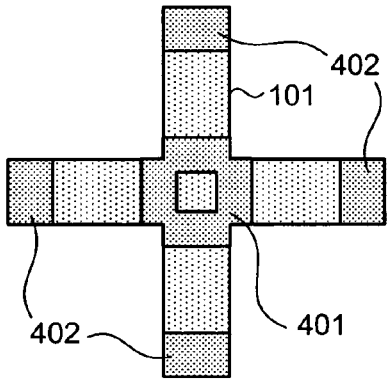

As shown in FIG. 4B, in the cross-like metal base 101, the portions to be bent between the center portion of the cross to be the end face and the side face portions to be the upper, lower, left, and right side faces after assembling the metal base 101 as a rectangular parallelepiped are spin-coated with resist, and are exposed and developed. In this manner, a resist pattern 401 is formed. The portions on which the resist pattern 401 is formed are to become the bending portions after the formation of the box-like structure.

Likewise, the portions to be the joint portion with which the metal rod 103 is to be joined after the cross-like plate is bent to form a three-dimensional figure are spin-coated with resist, and are exposed and developed. In this manner, a resist pattern 402 is formed.

The resist pattern 401 and 402 are formed at the same time.

Figure 4C:
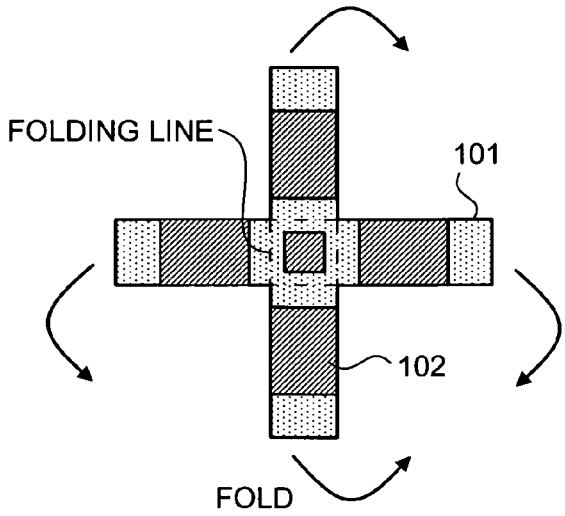

As shown in FIG. 4C, diamond particles are adhered only to the portions of the metal base 101 on which the resist patterns 401 and 402 are not formed. The diamond is then grown by CVD method, so as to form the diamond thin film 102. The procedures will be described later in detail.

Figure 4D:
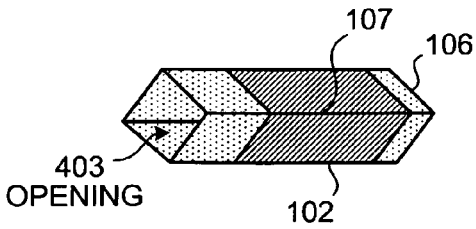

As shown in FIG. 4D, the portions on which the diamond thin film 102 is not formed are bent to form a box-like structure having an opening 403. The metal base 101 of the box-like structure is used for producing the cold cathode 100.

As described above, the cross-like plate having an end face and adjacent side faces is bent to form the metal base 101. Accordingly, the diamond thin film 102 on a side face is not integrally formed with the diamond thin film 102 on the adjacent side face. Rather, the diamond thin film 102 on each side face is formed independently of the diamond thin film 102 on the other side faces. The entire metal base 101 including the corner portions 106 between the end face and the side faces and the corner portions 107 between the side faces is not integrally coated with a diamond thin film. Accordingly, even if heat expansion is caused in the metal base 101, the diamond film 102 at the corner portions 106 and the corner portions 107 is not damaged.

Figure 5:
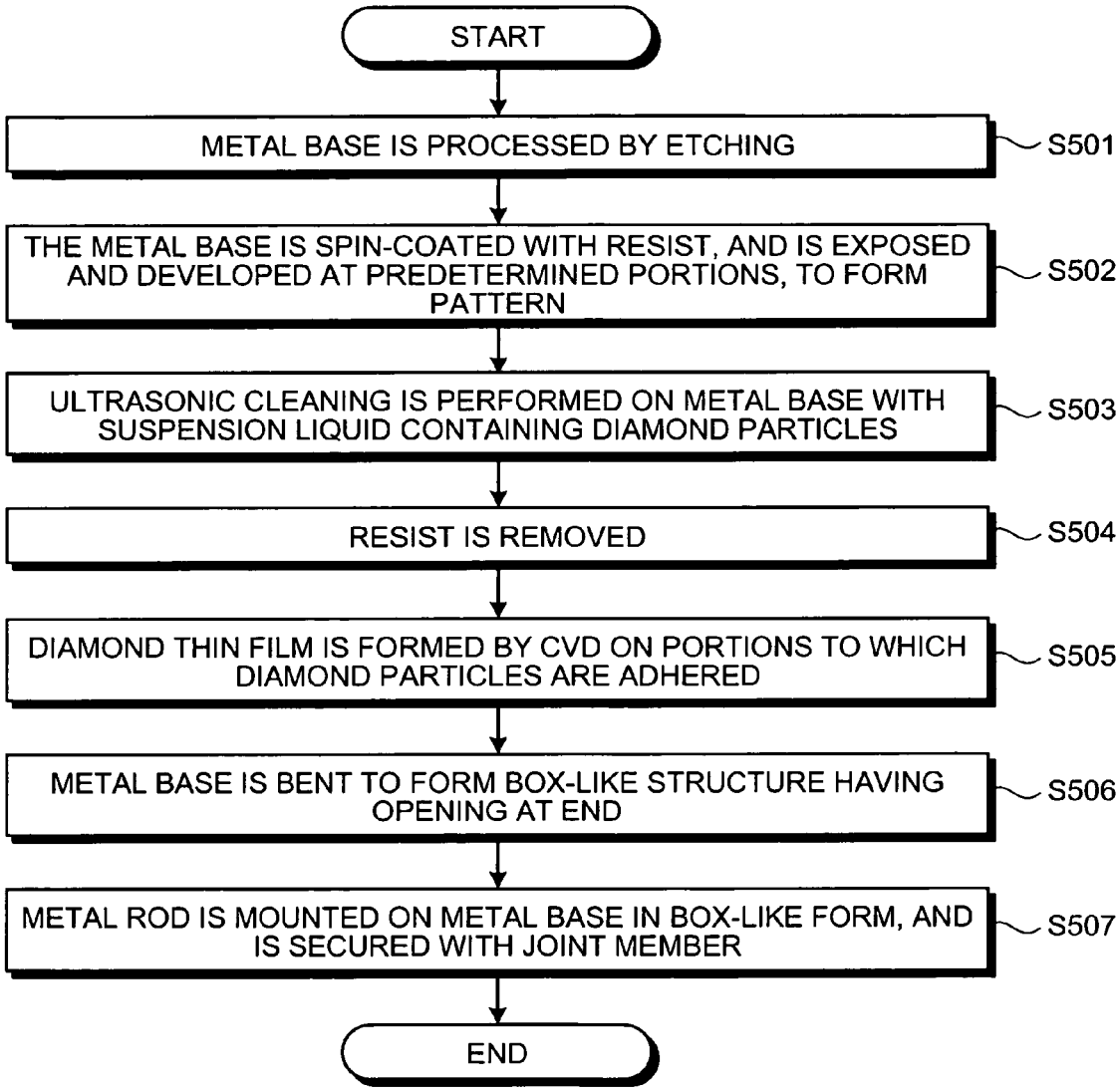
FIG. 5 is a flowchart showing the procedures in the operation of manufacturing the cold cathode of the first embodiment.

Next, the operation of manufacturing the cold cathode 100 according to this embodiment having the above-described structure is described. FIG. 5 is a flowchart showing the procedures in the operation according to this embodiment.

First, the metal base 101 of a desired shape that can be turned into a box-like structure by bending the plate-like metal material is produced by etching (step S501). The processing of the metal base 101 is not limited to etching, but may be performed with a conventional cutting tool.

Next, the metal base 101 is spin-coated with resist, and is then exposed and developed at predetermined portions, so that the resist patterns 401 and 402 are formed (step S502). The predetermined portions on which the resist patterns 401 and 402 are formed are described above, and therefore, explanation of them is not repeated herein.

The metal base 101 having the resist patterns 401 and 402 formed thereon is immersed in a suspension liquid that is produced by dispersing diamond particles in ethanol, and is cleaned by an ultrasonic cleaner (step S503). By doing so, the diamond particles are adhered to the surface of the metal base 101. The adhesion of diamond particles prior to the diamond film formation by CVD is called "seeding," which is generally employed for forming a diamond film. Therefore, explanation of the "seeding" is not repeated herein.

The resist patterns 401 and 402 are then removed (step S504). As a result, the metal base 101 has the diamond particles remaining only on the portions on which the resist patterns are not formed.

With the diamond particles being used as seed crystals, diamond is grown by plasma CVD, so that the diamond thin film 102 is formed only on the portions of the metal base 101 onto which the diamond particles are adhered (step S505). In this embodiment, the diamond thin film 102 is formed by plasma CVD, using an acetone-methanol mixture having molten $B_2O_3$. An acetone-ethanol mixture as a carbon source and $B_2O_3$ as a boron source are introduced into a chamber by hydrogen bubbling of a solution. By doing so, the polycrystalline diamond thin film 102 having conductivity with a thickness of approximately 10 μm, for example, is formed. The diamond thin film 102 is doped with boron (B). This embodiment does not limit the method of forming the diamond thin film to plasma CVD.

Next, the metal base 101 are bent at the portions not coated with the diamond thin film 102, which are the portions on which the resist pattern 401 is formed. Here, a box-like structure having an opening is produced (step S506). The bending is performed so that the faces having the diamond thin film 102 formed thereon become the outer faces of the box-like structure. The shapes of the metal base 101 before and after the bending have already been described in conjunction with FIGS. 4A to 4D, and therefore, explanation of them is not repeated herein.

After the metal rod 103 is inserted through the opening 403 of the box-like metal base 101, the metal rod 103 is secured to the metal base 101 with the joint member 104 (step S507). The portions on which the joint member 104 is mounted are the portions on which the diamond thin film 102 is not formed or the portions on which the resist pattern 402 was formed. Accordingly, the diamond thin film is not damaged at the portions having the joint member 104 mounted thereon.

The surface of the diamond thin film 102 after the film formation is hydrogenated and has negative electron affinity. Because of this, the electron emission characteristics are improved, and the discharge efficiency is increased. Thus, the cold cathode 100 is produced.

The above-described procedures are merely an example of the procedures for producing the cold cathode 100 of this embodiment, and the present invention is not limited to them.

In the above-described procedures, resist patterns are formed on the bending portions and the portions to be secured by the joint member 104, so as to prevent diamond particles from adhering to those portions and hinder the formation of the diamond thin film 102 at those portions. Accordingly, the diamond thin film 102 is not damaged in the bending process and the joining process, and the entire diamond thin film 102 is prevented from peeling at the bending portions and the joint portions.

Although the surface of the diamond thin film 102 is hydrogen-terminated, it may be acid-terminated by immersing the diamond thin film 102 in a hydrogen sulfuric acid peroxide solution.

In this embodiment, the diamond thin film 102 is formed on the metal base 101 processed into a predetermined two-dimensional form, and the metal base 101 is bent to form a three-dimensional structure. In this manner, the formation of a diamond film with a uniform thickness on a three-dimensional base, which has been difficult, can be easily performed. Accordingly, a cold cathode on which a diamond film with a uniform thickness is formed can be easily produced. Since the metal base 101 is bent after a diamond film is formed by CVD on the metal base 101 in a flat state, a cold cathode having a diamond film with a uniform thickness can be produced. Furthermore, because of the uniform thickness of the diamond film, a high discharge efficiency and a longer service life can be expected from a cathode.

Thus, cold cathodes coated with diamond can be mass-produced at low costs, without a complicated thin-film forming method.

In the cold cathode discharge lamp 200 manufactured in the above-described manner, the cold cathodes 100 are coated with diamond having a high secondary emission efficiency. Accordingly, the discharge starting voltage and sustaining voltage are much lower than those with conventional cold cathodes containing a metal such as nickel. Thus, power saving can be realized with the cold cathode discharge lamp 200, and a high discharge efficiency can be achieved. Also, since diamond has a low sputtering rate, the cold cathode discharge lamp 200 using the cold cathodes 100 can have a long service life.

Furthermore, the corner portions of each cold cathode 100 are not coated with the diamond thin film. Even if the metal rod or the metal base of the cold cathode 100 expands, the diamond thin film is not damaged. Thus, a long service life can be achieved.

As described above, in this embodiment, the diamond thin film 102 is formed on the metal base 101 in a flat state, and the metal base 101 is then bent to form a three-dimensional structure. The difficulty of forming a diamond film on a non-flat base is eliminated this way, and a cold cathode discharge lamp with a high discharge efficiency and a long service life can be manufactured at a low cost, taking advantage of the high secondary emission efficiency and the high sputtering rate of diamond.

The cold cathode discharge lamp 200 may be used in such an apparatus as a plasma display.

This embodiment is not limited to the above-described structure, but may be modified in various manners as follows.

In the above-described first embodiment, the box-like metal base 101 having the diamond thin film 102 formed thereon is formed as a rectangular parallelepiped having the opening 403. However, the box-like shape of the metal base 101 is not limited to a rectangular parallelepiped. The box-like shape may be a cubic shape, a polygonal shape, or a cylindrical shape, as long as it can be mounted on the metal rod 103 having an extension lead and can be energized.

In a first modification of the first embodiment, it is explained that an octagonal structure having an opening on one end face is used as the box-like metal base having a diamond thin film formed thereon. The production procedures and the structure of a cold cathode of this modification are the same as those of the first embodiment, and therefore, explanation of them is not repeated herein.

Figure 6A:
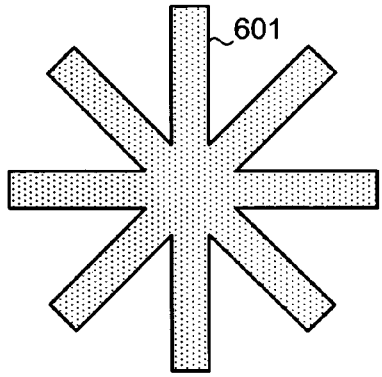
FIGS. 6A to 6D show the procedures for producing a thin-film metal plate in an octagonally cylindrical shape that is used in a cold cathode as a modification of the first embodiment and has a diamond thin film formed thereon.

FIGS. 6A to 6D show the procedures for producing an octagonal metal base 601 that has a diamond thin film formed thereon and is used in a cold cathode according to this modification. As shown in FIG. 6A, a metal plate is etched to produce such a metal plate as to become an octagonal structure having an opening. The thickness of the metal plate is not particularly set, but may preferably be so thin that a bending process can be performed in a later stage.

Figure 6B:
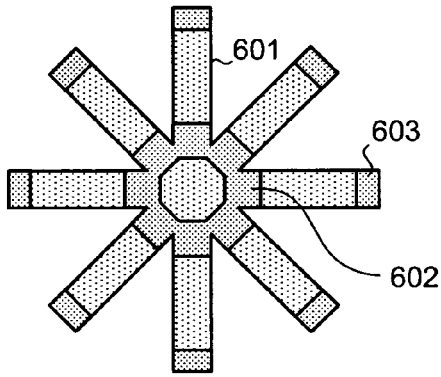

As shown in FIG. 6B, in the metal base 601, the portions to be bent between the center portion to be the end face and the side face portions extending in eight directions to be side faces after assembling are spin-coated with resist, and are exposed and developed. In this manner, a resist pattern 602 is formed.

Likewise, the end portions of the side face portions are spin-coated with resist, and are exposed and developed. In this manner, a resist pattern 603 is formed.

The resist pattern 602 and 603 are formed at the same time.

Figure 6C:
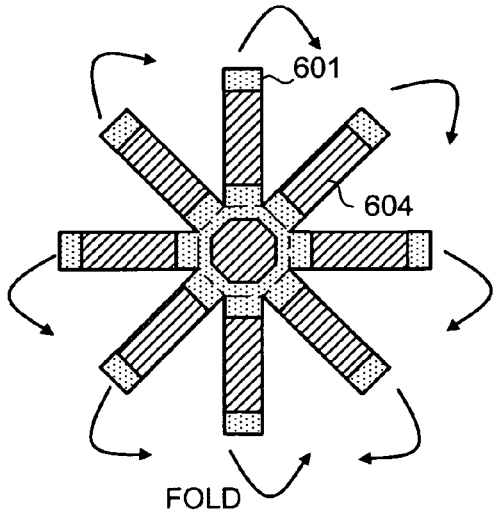

As shown in FIG. 6C, diamond particles are adhered only to the portions of the metal base 601 on which the resist patterns 602 and 603 are not formed. The diamond is then grown by the CVD method with the diamond particles serving as seed crystals, so as to form a diamond thin film 604. The detailed procedures for forming the diamond thin film 604 are the same as those in the first embodiment, and therefore, explanation of them is not repeated herein.

Figure 6D:
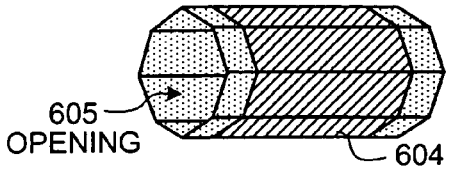

As shown in FIG. 6D, the portions on which the diamond thin film 604 is not formed are bent to form an octagonally cylindrical structure having an opening 605. The metal base 601 of the octagonally cylindrical structure is used for producing a cold cathode.

A metal rod of octagonally cylindrical shape is then mounted on the octagonally cylindrical metal base 601 produced as described above. The metal rod is jointed to the metal base 601 by the joint member so as to form the cold cathode. Since a cold cathode discharge lamp is of a rectangular tube shape, a metal base closer to a cylindrical shape can have a diamond thin film in a larger area, with the same inner diameter. Having an octagonally cylindrical shape, instead of a rectangular parallelepiped shape, the cold cathode of this modification is closer to a cylindrical shape. Accordingly, with the octagonally cylindrical shape of this modification, the area of the diamond thin film coating the cold cathode is larger. Thus, the discharge area becomes larger, and a higher discharge current can be obtained.

Also, as in the first embodiment, a diamond thin film with a high secondary emission efficiency is used in the cathode. Accordingly, the discharge voltage can be dramatically made lower.

Although only the outer surface of the metal base 101 is coated with the diamond thin film 102 in the cold cathode 100 according to the first embodiment, a second embodiment of the present invention provides a cold cathode having both surfaces of a metal base coated with a diamond thin film.

Figure 7:
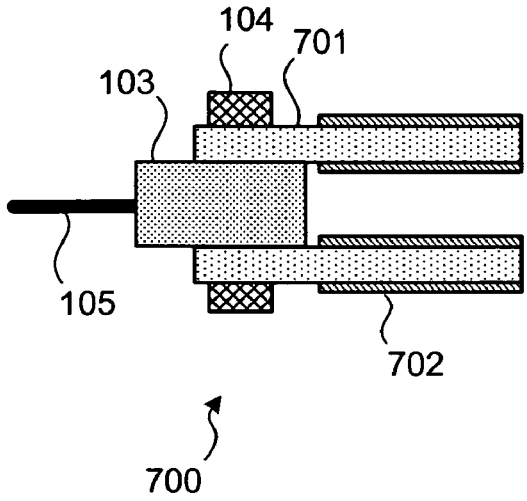
FIG. 7 is a cross-sectional view of a cold cathode according to a second embodiment of the present invention.

FIG. 7 is a cross-sectional view of a cold cathode 700 according to the second embodiment. As shown in FIG. 7, the cold cathode 700 includes a metal rod 103 having an extension lead 105 for applying a voltage from the outside, a metal base 701 of rectangular shape having openings on two opposite faces, a diamond thin film 702 formed on the outer surface and the inner surface of the metal base 701, and a joint member 104 for joining the metal base 701 to the metal rod 103. In the following description, the same components as those of the first embodiment are denoted by the same reference numerals as those used in the first embodiment.

The metal used for the metal base 701 is the same as in the first embodiment. The diamond thin film 702 is formed on the metal base 701. The procedures for forming the diamond thin film 702 will be described later.

Figure 8:
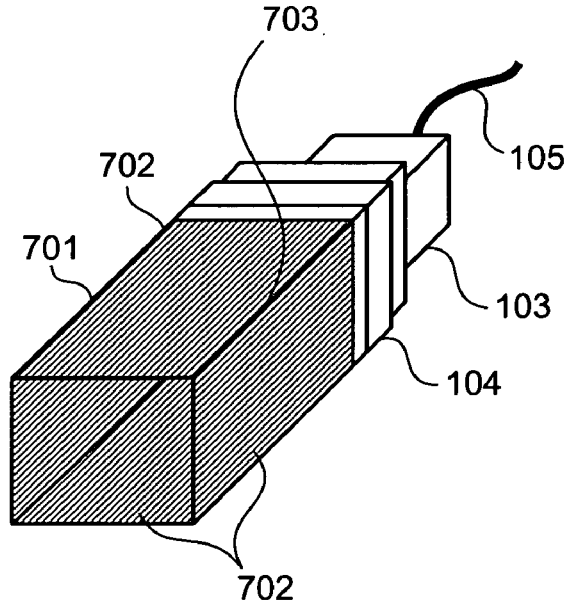
FIG. 8 is an external view of the cold cathode according to the second embodiment.

FIG. 8 is an external view of the cold cathode 700 according to this embodiment. The face through which the metal rod 103 is inserted and the face opposite to it are open, and the inner surface of the metal base 701 of rectangular shape is coated with the diamond thin film 702. This structure virtually functions as a cup-like structure. Accordingly, the cold cathode 700 of this embodiment embodies a cup-like cold cathode having openings. The metal base 701 shown in FIG. 8 is formed by bending the bending portions that are not coated with the diamond thin film 702.

The cold cathode 700 traps electrons in the cup-like structure, so as to increase the gas ionization efficiency by virtue of the electrons. This is the so-called hollow effect. Taking advantage of the hollow effect, the discharge voltage is further lowered to obtain a higher discharge current. Accordingly, a greater effect than the effect of simply increasing the area of the diamond thin film can be found in the discharge voltage. In this structure, the electrons emitted from a cathode are returned by the cathode on the opposite face, so that the ionization efficiency is increased, and a lower discharge voltage is obtained.

Like the corner portion in the first embodiment, the corner portions 703 between the side faces are not integrally coated with the diamond thin film 702. Accordingly, even if heat expansion is caused in the metal base 701, the diamond thin film 702 is not damaged.

FIGS. 9A to 9F show the procedures for producing the metal base 701 of the rectangular shape that is used in the cold cathode 700 of this embodiment and has the diamond thin film 702 formed thereon.

Figure 9A:
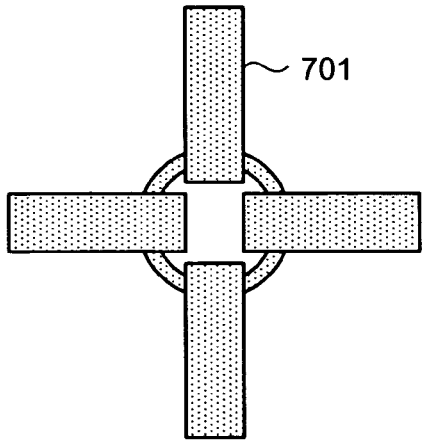
FIGS. 9A to 9F show the procedures for producing a thin-film metal plate in a rectangular tube shape that is used in the cold cathode of the second embodiment and has a diamond thin film formed thereon.

As shown in FIG. 9A, a metal plate is etched to produce a metal plate 701 having four side faces and portions linking the four side faces, with the opposite end faces being open. The thickness of the metal plate is not particularly set, but should preferably be so thin that a bending process can be performed in a later stage. The portions linking the side faces to one another are to be bent when the rectangular is formed, or serve as the bending portions.

Figure 9B:
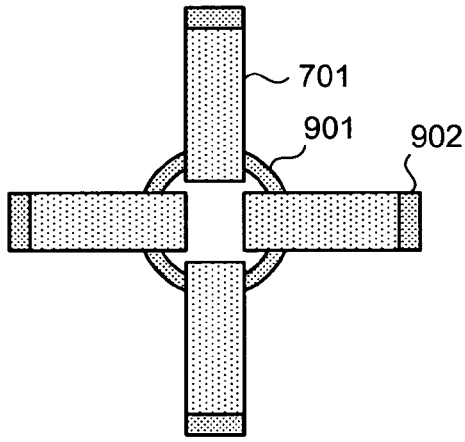

As shown in FIG. 9B, in the metal plate 701, the portions linking the side faces to one another are spin-coated with resist, and are exposed and developed. In this manner, a resist pattern 901 is formed.

Likewise, the portions to which the joint member is to be mounted after a three-dimensional structure is formed are spin-coated with resist, and are exposed and developed. In this manner, a resist pattern 902 is formed.

The resist pattern 901 and 902 are formed at the same time.

Figure 9C:
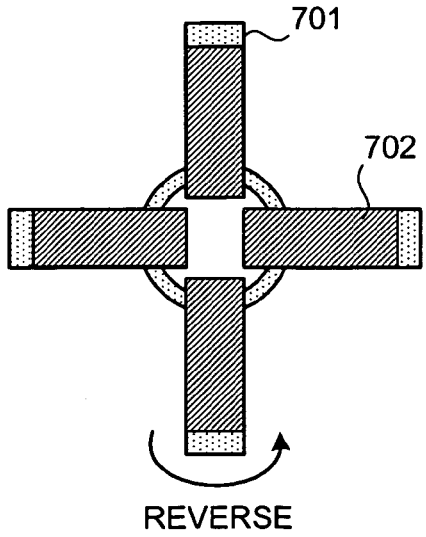

As shown in FIG. 9C, diamond particles are adhered only to the portions of the metal base 701 on which the resist patterns 901 and 902 are not formed. With the diamond particles serving as seed crystals, diamond is grown, so as to form the diamond thin film 702. The procedures for forming the diamond thin film 702 are the same as those of the first embodiment, and therefore, explanation of them is not repeated herein. Through this process, the diamond thin film 702 is formed on one surface of the metal base 701.

Figure 9D:
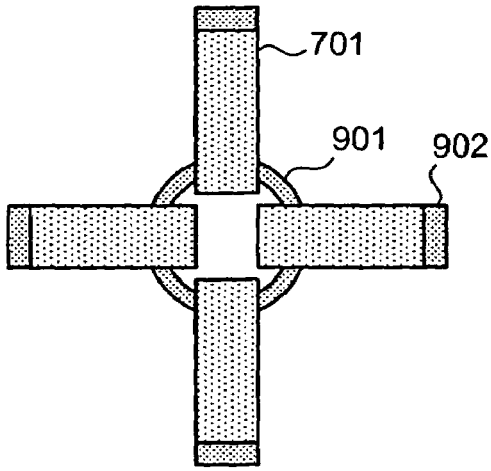

As shown in FIG. 9D, the metal base 701 is then reversed, and the same portions as those shown in FIG. 9D are spin-coated with resist, and are exposed and developed. In this manner, resist patterns 901 and 902 are formed.

Figure 9E:
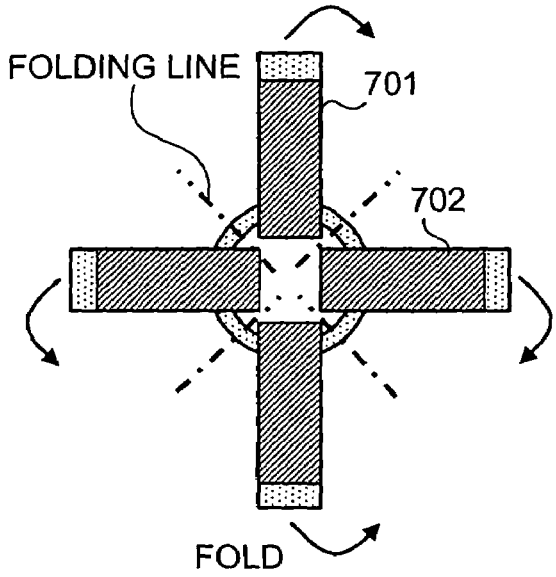

As shown in FIG. 9E, diamond particles are adhered only to the portions of the metal base 701 on which the resist patterns 901 and 902 are not formed. With the diamond particles serving as seed crystals, diamond is grown by CVD, so as to form the diamond thin film 702. Through this process, the diamond thin film 702 is formed on the other surface of the metal base 701.

Figure 9F:
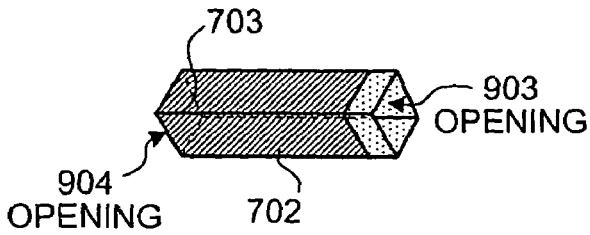

As shown in FIG. 9F, the metal base 701 is bent at the portions linking the side faces and not having the diamond thin film 702 formed thereon, so as to form a rectangular having openings 903 and 904 at both end faces. Although not seen from FIG. 9F, the opening 904 is formed on the face opposite to the face having the opening 903. Using the metal base 701 of rectangular shape, the cold cathode 700 is produced. The portions linking the side faces to one another are not shown in FIG. 9F. For ease of explanation, those portions linking the side faces are not shown in FIG. 8 either. In the cold cathode 700 produced as described above, the corner portions 703 between the side faces are not integrally coated with the diamond thin film 702. Thus, the metal base 701 can be protected from damage due to heat expansion.

By forming the metal base 701 in this manner, the difficulty of forming a diamond film on the inner face of the cup-like metal base is eliminated, and the same discharge voltage as that in a cold cathode using a cup-like metal base coated with a diamond thin film can be obtained. Also, the cold cathode 700 can be easily produced.

Figure 10:
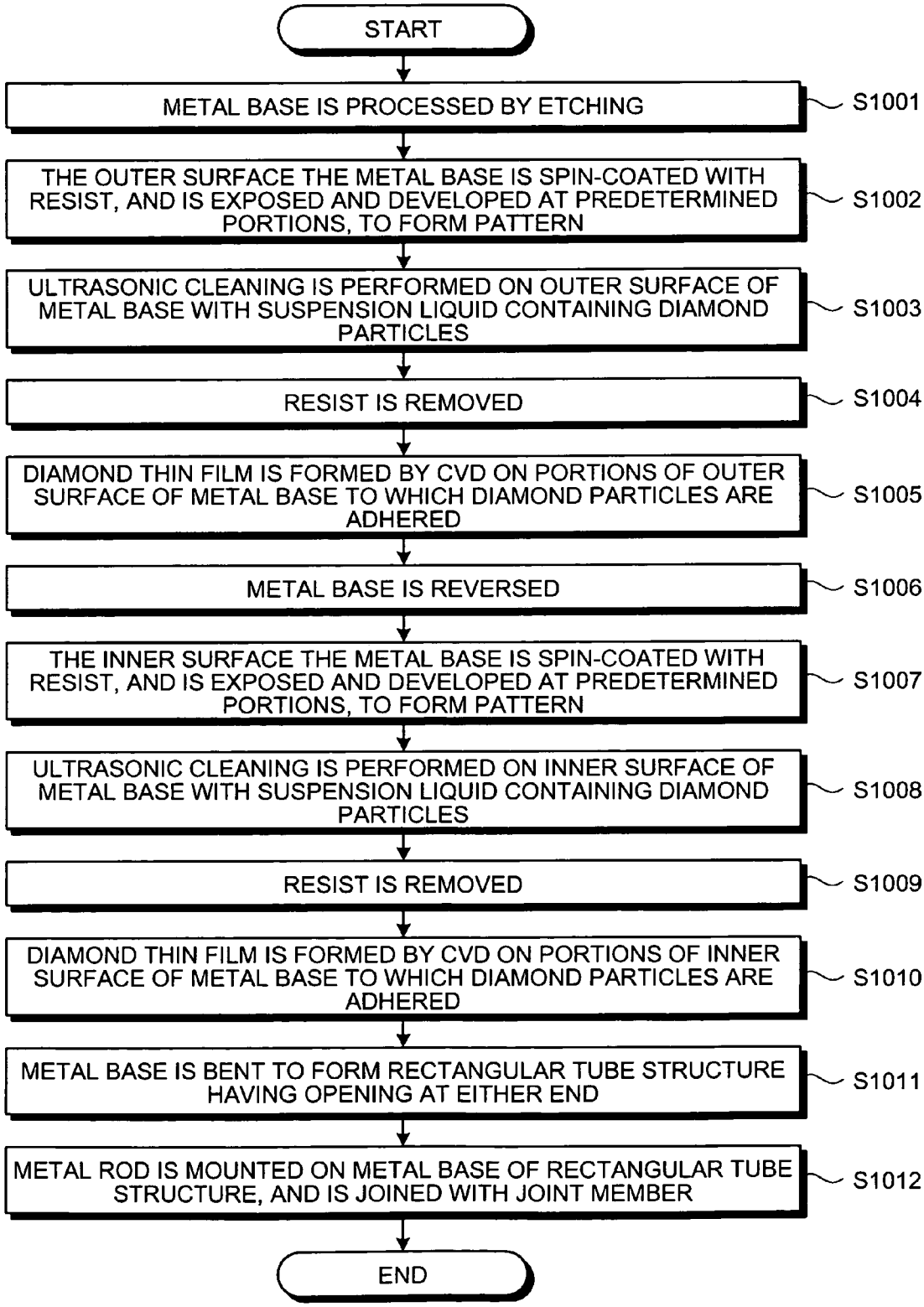
FIG. 10 is a flowchart showing the procedures in the operation of manufacturing the cold cathode of the second embodiment.

Next, the operation of manufacturing the cold cathode 700 according to this embodiment having the above-described structure is described. FIG. 10 is a flowchart showing the procedures in the operation according to this embodiment.

First, the metal base 701 of a desired shape that can be turned into a rectangular tube shape by bending the metal material at predetermined portions is produced by etching (step S1001). In this description, the surface to be first processed is set as the outer surface, and the surface to be processed later is set as the inner surface of the metal base 701. However, the surfaces are defined so for ease of explanation, and there is not a difference between the outer surface and the inner surface. The portions to be bent are shown in FIGS. 9A to 9F, and therefore, explanation of them is not repeated herein.

Next, the outer surface the metal base 701 is spin-coated with resist, and is then exposed and developed at predetermined portions, so that the resist patterns 901 and 902 are formed (step S1002). The predetermined portions on which the resist patterns 901 and 902 are formed are described above, and therefore, explanation of them is not repeated herein.

The surface of the metal base 701 having the resist patterns 901 and 902 formed thereon is immersed in a suspension liquid that is produced by dispersing diamond particles in ethanol, and is cleaned by an ultrasonic cleaner (step S1003).

The resist patterns 901 and 902 are then removed (step S1004).

With the diamond particles being used as seed crystals, diamond is grown by plasma CVD, so that the diamond thin film 702 is formed only on the portions of the metal base 701 onto which the diamond particles are adhered (step S1005). The formation of the diamond thin film 702 is the same as that in the first embodiment, and therefore, explanation of the diamond film formation is not repeated herein.

Next, the metal base 701 is reversed (step S1006). The procedures of steps S1002 to S1005 carried out on the outer surface of the metal base 701 are repeated on the inner surface (steps S1007 to S1010).

After the diamond thin film 702 is formed on both surfaces of the metal base 701, the metal base 701 are bent at the portions not coated with the diamond thin film 702, which are the portions on which the resist pattern 901 is formed. Here, a rectangular tube shape having an opening at either end is produced (step S1011). The shapes of the metal base 701 before and after the bending have already been described in conjunction with FIGS. 9A to 9D, and therefore, explanation of them is not repeated herein.

After the metal rod 103 is inserted through an opening of the metal base 701 of the rectangular shape, the metal rod 103 is joined to the metal base 701 with the joint member 104 (step S1012). The portions on which the joint member 104 is mounted for joining the metal base 701 and the metal rod 103 are the portions on which the diamond thin film 702 is not formed or the portions on which the resist pattern 902 was formed. Accordingly, the diamond thin film is not damaged at the time of joining.

The surface of the diamond thin film 702 after the film formation is hydrogenated and has negative electron affinity. Because of this, the electron emission characteristics are improved, and the discharge efficiency is increased. Thus, the cold cathode 700 is produced. Hydrogen plasma treatment is of course carried out on the diamond thin film 702 formed on both surfaces of the metal base 701.

Through the above-described procedures, the cold cathode 700 can be produced. However, the above-described procedures are merely an example of the procedures for producing the cold cathode 700 of this embodiment, and the present invention is not limited to them.

In the above-described procedures, resist patterns are formed on the bending portions and the portions to be secured by the joint member 104, so as to prevent diamond particles from adhering to those portions and hinder the formation of the diamond thin film 702 at those portions. Accordingly, the diamond thin film 702 is not damaged in the bending process and the joining process, and the entire diamond thin film 702 is prevented from peeling at the bending portions and the joint portions.

As described above, the metal base 701 is bent at the portions linking the side faces to one another. Accordingly, the diamond thin film 702 on a side face is not integrally formed with the diamond thin film 702 on the adjacent side face. Rather, the diamond thin film 702 on each side face is formed independently of the diamond thin film 702 on the other side faces. The entire metal base 701 including the corner portions 703 is not integrally coated with a diamond thin film. Accordingly, even if heat expansion is caused, the diamond thin film 702 does not restrict the variation in volume. Thus, a load is not put on the diamond thin film 702, and the diamond film 702 is not damaged.

As in the first embodiment, a diamond thin film with a high secondary emission efficiency is used for each cathode in this embodiment, so as to dramatically reduce the discharge voltage. The cold cathode 700 of cup-like shape traps electrons in the cup-like structure, so as to increase the gas ionization efficiency by virtue of the electrons. This is the so-called hollow effect. Taking advantage of the hollow effect, the discharge voltage is further lowered to obtain a higher discharge current.

By the method of manufacturing a cold cathode according to this embodiment, a metal base is formed as a rectangular tube shape having four side faces. However, the shape of the metal base is not limited to that, and the metal base may have various shapes. As shown in the modification of the first embodiment, a cold cathode of octagonally cylindrical shape that is closer to a cup-like structure may be produced, so as to obtain a higher discharge efficiency.

As described above, the cold cathodes for discharge lamps, the cold cathode discharge lamps, and the methods of manufacturing the cold cathodes for discharge lamps according to the present invention are suitable for apparatuses that are expected to have long service lives and consume less electricity when the cold cathode discharge lamps are used, such as the backlights for liquid crystal displays.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cold cathode for a discharge lamp, comprising:

a metal plate that has bending portions;

a diamond film that is formed on a face of the metal plate, except for the bending portions; and a metal member that is mounted on the metal plate.

2. The cold cathode according to claim 1, wherein the diamond film is formed on each face of the metal plate, except for the bending portions.

3. The cold cathode according to claim 1, wherein the metal plate contains a metal material having a melting point of 1000° C. or higher.

4. The cold cathode according to claim 1, wherein the diamond film is hydrogen-terminated.

5. The cold cathode according to claim 1, wherein the metal plate is designed to have a box-like shape having an opening.

6. The cold cathode according to claim 2, wherein the metal plate is designed to have a polygonal drum shape having two openings located opposite to each other, and the metal member is mounted in one of the two openings.

7. A cold cathode discharge lamp, comprising:

a cold cathode that includes a metal plate having bending portions, a diamond film formed on faces of the metal plate, except for the bending portions, and a metal member mounted on the metal plate;

a glass tube that has the cold cathode therein, and has a fluorescent material applied to an inner wall thereof; and an inert gas that is contained in the glass tube.

8. The cold cathode discharge lamp according to claim 7, wherein the diamond film of the cold cathode is formed on each face of the metal plate, except for the bending portions.

9. The cold cathode discharge lamp according to claim 7, wherein the metal plate of the cold cathode is a metal material having a melting point of 1000° C. or higher.

10. The cold cathode discharge lamp according to claim 7, wherein the diamond film of the cold cathode is hydrogen-terminated.

11. The cold cathode discharge lamp according to claim 7, wherein the metal plate of the cold cathode is designed to have a box-like shape having an opening.

12. The cold cathode discharge lamp according to claim 8, wherein the metal plate of the cold cathode is designed to have a polygonal drum shape having two openings located opposite to each other, and the metal member of the cold cathode is mounted in one of the two openings.

* * * * *